US006695161B2

(12) United States Patent
Kano et al.

(10) Patent No.: US 6,695,161 B2
(45) Date of Patent: Feb. 24, 2004

(54) PLASTIC CONTAINER CLOSURE

(75) Inventors: Yuji Kano, Hiratsuka (JP); Yoshihiro Kaitsuka, Hiratsuka (JP)

(73) Assignee: Japan Crown Cork Co., Ltd., Tokyo (JP)

( * ) Notice: Subject to any disclaimer, the term of this patent is extended or adjusted under 35 U.S.C. 154(b) by 23 days.

(21) Appl. No.: 09/778,768

(22) Filed: Feb. 8, 2001

(65) Prior Publication Data

US 2002/0158037 A1 Oct. 31, 2002

(51) Int. Cl.[7] ..... B65D 53/00; B65D 41/04; B65D 41/34

(52) U.S. Cl. ..... 215/341; 215/354; 215/DIG. 1

(58) Field of Search ..... 215/341, 344, 215/345, 354, DIG. 1

(56) References Cited

U.S. PATENT DOCUMENTS 3,568,871 A * 3/1971 Livingstone ..... 215/344
3,815,771 A * 6/1974 Marks ..... 215/344
4,489,845 A * 12/1984 Aichinger et al. ..... 215/344
4,907,709 A * 3/1990 Abe et al. ..... 215/344
5,161,707 A * 11/1992 Dutt et al. ..... 215/344
6,126,027 A * 10/2000 Thompson ..... 215/344
6,325,226 B1 * 12/2001 Krautkramer ..... 215/344

FOREIGN PATENT DOCUMENTS

JP 10-35699 * 2/1998
JP 2000-79954 * 3/2000
JP 2000-109105 * 4/2000

* cited by examiner

*Primary Examiner*—Nathan J. Newhouse

(57) ABSTRACT

A container closure has a top panel wall, and an annular seal piece and an annular contact piece are integrally formed in an outer peripheral edge portion of an inner surface of the top panel wall. The annular seal piece is of such a shape as to be deflected radially outwardly upon contact with the cylindrical outer peripheral surface of the mouth-and-neck portion of a container. The annular contact piece is brought into contact with an annular boundary surface extending from an annular top surface to an annular outer peripheral surface of the mouth-and-neck portion of the container when viewed arcuately in a sectional view. An annular thin-walled region positioned radially inwardly of the annular seal piece and the annular contact piece are further formed in the outer peripheral edge portion of the inner surface of the top panel wall.

10 Claims, 9 Drawing Sheets

PLASTIC CONTAINER CLOSURE

FIELD OF THE INVENTION

This invention relates to a plastic container closure suitable for a container for a beverage, especially a container for a carbonated beverage.

DESCRIPTION OF THE PRIOR ART

A container formed from a plastic material, such as polyethylene terephthalate or glass, is widely used as a container for a beverage. Such a container includes a nearly cylindrical mouth-and-neck portion, and an external thread is formed on an outer peripheral surface of the mouth-and-neck portion. An upper end part of the mouth-and-neck portion, normally positioned above the external thread, has an annular top surface extending substantially horizontally, a cylindrical outer peripheral surface extending substantially vertically, and a cylindrical inner peripheral surface extending substantially vertically. The annular top surface and the cylindrical inner peripheral surface are connected together, substantially directly or via an annular boundary surface extending arcuately over a slight length in a sectional view. Similarly, an annular boundary surface, extending substantially arcuately over a considerable length in a sectional view, exists between the annular top surface and the cylindrical outer peripheral surface.

Recently, a plastic container closure formed from a plastic material, such as high density polyethylene or polypropylene, has found practical use as a container closure for sealing the mouth-and-neck portion of a container having the above-described shape. A typical example of such a plastic container closure has a circular top panel wall, and a cylindrical skirt wall extending downwardly from a peripheral edge of the top panel wall, as disclosed, for example, in Japanese Unexamined Patent Publication No. 73551/1983. An internal thread is formed on an inner peripheral surface of the skirt wall. An annular seal piece, which may extend downwardly obliquely in a radially inward direction, is formed in an outer peripheral edge portion of the inner surface of the top panel wall. An annular contact piece positioned radially inwardly of the annular seal piece, and an annular positioning piece extending downwardly at a position radially inward of the contact piece are also often formed in the outer peripheral edge portion of the inner surface of the top panel wall.

In mounting the container closure on the mouth-and-neck portion of the container to seal the mouth-and-neck portion, the container closure is capped over the mouth-and-neck portion, and turned in a closing direction to screw the internal thread of the container closure onto an external thread of the mouth-and-neck portion. During this motion, the annular positioning piece of the container closure is lowered along the inner peripheral surface of the upper end part of the mouth-and-neck portion. By this action, the container closure is aligned with the mouth-and-neck portion to match the center line of the container closure to the center line of the mouth-and-neck portion. When the internal thread of the container closure is screwed onto the external thread of the mouth-and-neck portion with a required rotating torque, the annular seal piece of the container closure is intimately contacted with the outer peripheral surface in the upper end part of the mouth-and-neck portion, whereby the mouth-and-neck portion is sealed. The contact piece of the container closure is brought into contact with the substantially horizontally extending top surface of the mouth-and-neck portion, whereby the vertical position of the container closure relative to the mouth-and-neck portion is restricted.

The conventional plastic container closure of the foregoing shape poses the following problem to be solved: Assume that a carbonated beverage containing a carbon dioxide gas is held in the container. When the ambient temperature reaches 40 degrees centigrade, for example, a considerably high gas pressure (e.g., a gas pressure of about 6 kg/cm$^2$) is generated in the container. Such a gas pressure causes a so-called dome phenomenon in which the top panel wall of the container closure is deformed upward in a domic shape. As is well known among people skilled in the art, a container filled with a carbonated beverage and mounted with a container closure is usually accommodated in a carton (a box made of a folding boxboard). The cartons accommodating a required number of the containers are stored and transported in a stacked condition. During their storage and transportation, a considerable load (a load, for example, of about 10 kg) is imposed on the top panel wall of the container closure mounted on the mouth-and-neck portion of the container. According to experiments conducted by the inventors of the present invention, when a considerably great stacking load is imposed on the top panel wall of the container closure subject to the dome phenomenon, the seal on the mouth-and-neck portion by the container closure tends to be destroyed, resulting in leakage of the gas pressure from inside the container. To solve this problem, it is conceivable to form a sealing liner of a required shape on the inner surface of the top panel wall of the container closure, separately from the container closure body, by a well-known embossing method. By so doing, however, the manufacturing cost of the container closure is considerably increased.

SUMMARY OF THE INVENTION

A principal object of the present invention is to provide an improved plastic container closure which can be produced without an increase in the manufacturing cost, and which nevertheless, enables sealing of the mouth-and-neck portion by the container closure to be maintained fully reliably, even when a considerably great stacking load is imposed on the top panel wall of the container closure undergoing a dome phenomenon.

As a result of extensive studies and experiments, the inventors found the following facts, to their surprise: When the annular contact piece is changed to such a shape as to contact the annular boundary surface extending arcuately in the sectional view, rather than contacting the substantially horizontally extending top surface of the mouth-and-neck portion, sealing of the mouth-and-neck portion by the container closure can be maintained fully reliably, even if a considerably great stacking load is imposed on the top panel wall of the container closure when the above-mentioned dome phenomenon is caused to the top panel wall of the container closure. The reason why sealing of the mouth-and-neck portion can be maintained fully reliably by such a change applied to the annular contact piece of the container closure is not necessarily clear, but the inventors believe it to be as follows: Generally, when the dome phenomenon is caused to the top panel wall, the top panel wall is deformed upward in a region inward of the annular boundary surface of the mouth-and-neck portion. In other words, the top panel wall bulges upward more greatly in its region closer to its center, with the annular boundary surface of the mouth-and-neck portion as a fulcrum. If the annular contact piece of the container closure is in contact with the top surface inward of the annular boundary surface of the mouth-and-neck portion, the top panel wall is deformed, when a stacking load is imposed on the top panel wall undergoing the dome phenomenon. In accordance with this deformation, the annular contact piece is also deformed or moved. At the same time, the deformation of the top panel wall is transmitted to the annular seal piece. As a result, the annular seal piece is also deformed to destroy sealing of the mouth-and-neck portion. On the other hand, when the annular contact piece of the container closure is brought into contact with the annular boundary surface of the mouth-and-neck portion, namely, the fulcrum for the deformation of the top panel wall, the tendency toward the deformation or movement of the annular contact piece by the deformation of the top panel wall is considerably lessened. Moreover, the tendency to deformation of the annular seal piece due to the deformation of the top panel wall is considerably suppressed. Hence, the sealing of the mouth-and-neck portion is maintained.

SUMMARY

According to a first aspect of the present invention, as a plastic container closure for attaining the aforementioned technical object, there is provided a plastic container closure which is to be applied to a container having an annular top surface extending substantially horizontally, a cylindrical outer peripheral surface extending substantially vertically, and an annular boundary surface extending from the top surface to the outer peripheral surface substantially arcuately in a sectional view, the top surface, the outer peripheral surface, and the boundary surface being formed in an upper end part of a mouth-and-neck portion of the container, the container closure comprising:

a circular top panel wall; and a cylindrical skirt wall extending downwardly from a peripheral edge of the top panel wall, and wherein an annular seal piece and an annular contact piece are integrally formed in an outer peripheral edge portion of an inner surface of the top panel wall, the annular seal piece extending downwardly obliquely in a radially inward direction and being brought into intimate contact With the outer peripheral surface of the mouth-and-neck portion of the container, whereby the annular seal piece is deflected radially outwardly, and the annular contact piece being brought into contact with the boundary surface of the mouth-and-neck portion.

In a preferred embodiment, the annular contact piece is composed of a bulgy portion which bulges downward in a radially inward direction and is compressed upon contact with the boundary surface of the mouth-and-neck portion of the container. The annular contact piece may be of such a shape as to have an inclined surface which extends obliquely upwardly from a base portion of the annular seal piece in a radially inward direction, and to be compressed upon contact with the boundary surface of the mouth-and-neck portion. The annular contact piece may also be composed of a protrusive portion which protrudes downwardly or radially inwardly, and is deflected upward upon contact with the boundary surface of the mouth-and-neck portion of the container. When the minimum inner diameter of the annular seal piece is designated as D1, and the outer diameter of the outer peripheral surface of the mouth-and-neck portion is designated as D2, it is preferred that D2=D1=0.30 to 1.00 mm. Preferably, a cylindrical inner peripheral surface extending substantially vertically is formed in the upper end part of the mouth-and-neck portion of the container, and an annular positioning piece, located radially inwardly of the contact piece and extending downward, is formed in the outer peripheral edge portion of the inner surface of the top panel wall. When the maximum outer diameter of the annular positioning piece is designated as D3, and the inner diameter of the inner peripheral surface of the mouth-and-neck portion of the container is designated as D4, it is preferred that D4–D3=0.07 to 0.16 mm.

The inventors further conducted extensive studies and experiments, and found the following facts: When an annular thin-walled region is formed radially inwardly of the annular seal piece in the top panel wall, deformation of the top panel wall (i.e., a dome-shaped deformation, or the dome-shaped deformation forcibly returned to the original state) is restricted mainly to a region inward of the annular thin-walled region, and deformation of the top panel wall in an area radially outward of the annular thin-walled region is fully suppressed. Thus, deformation or movement of the annular seal piece is fully suppressed. Consequently, even when a considerably great stacking load is imposed on the top panel wall of the container closure undergoing the dome phenomenon, sealing of the mouth-and-neck portion of the container by the container closure can be maintained fully reliably.

According to a second aspect of the present invention, as a plastic container closure for attaining the aforementioned technical object, there is provided a plastic container closure which is applied to a mouth-and-neck portion of a container, and which comprises:

a circular top panel wall; and a cylindrical skirt wall extending downwardly from a peripheral edge of the top panel wall, and wherein an annular seal piece, to be brought into intimate contact with the mouth-and-neck portion of the container, is integrally formed in an outer peripheral edge portion of an inner surface of the top panel wall, and an annular thin-walled region positioned radially inwardly of the annular seal piece is formed in the outer peripheral edge portion of the top panel wall.

Preferably, the annular thin-walled region has a width of 0.5 to 5.0 mm, and a thickness of 0.5 to 1.1 mm.

DETAILED DESCRIPTION OF THE PREFERRED EMBODIMENTS

Preferred embodiments of a plastic container closure constituted in accordance with the present invention will now be described in further detail with reference to the accompanying drawings.

Figure 1:
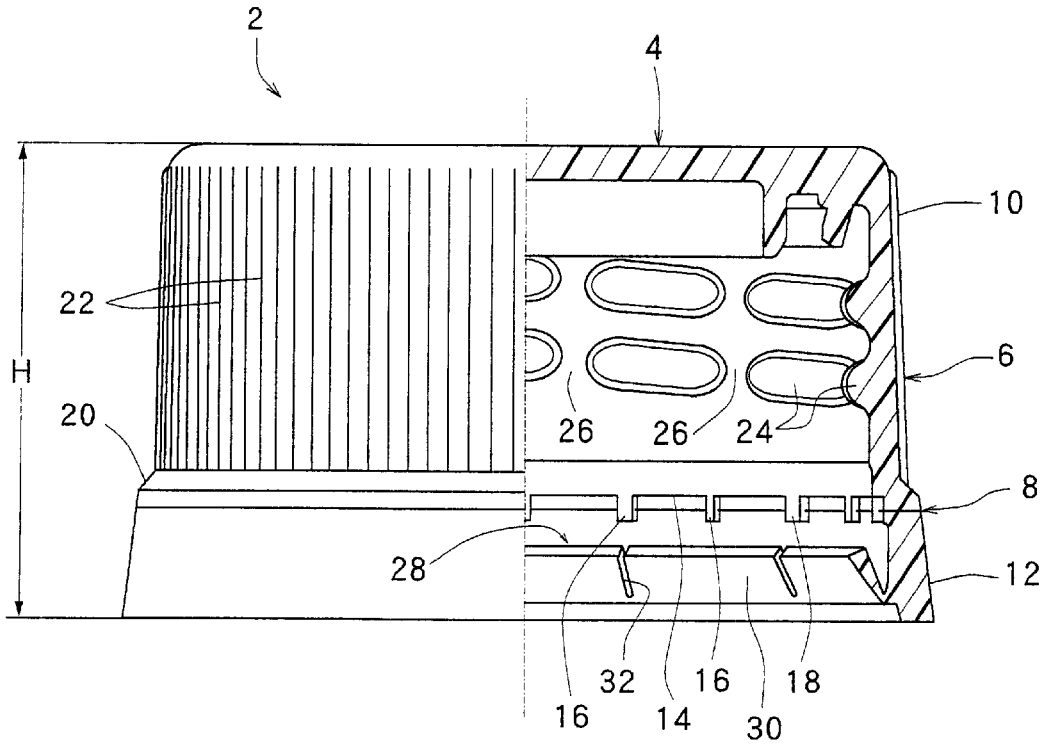
FIG. 1 is a view showing, partly as a sectional view and partly as a side view, a preferred embodiment of a container closure constituted in accordance with the present invention.

With reference to FIG. 1, a plastic container closure constituted in accordance with the present invention and designated entirely by the numeral 2 is integrally formed, as a whole, from a plastic material, preferably a relatively rigid plastic material, such as high density polyethylene or polypropylene. Such a container closure 2 has a circular top panel wall 4, and a nearly cylindrical skirt wall 6 extending downwardly from the peripheral edge of the top panel wall 4. In the skirt wall 6, a breakable line 8 extending in a circumferential direction is formed. The skirt wall 6 is divided into a main portion 10 above the breakable line 8, and a tamper evident bottom portion 12 below the breakable line 8. An annular shoulder surface 14 facing downward is formed on an inner peripheral surface of the skirt wall 6. A plurality of projections 16 extending downward from the annular shoulder surface 14 are formed with suitable spacing in the circumferential direction. The breakable line 8 is formed by applying a cutting blade (not shown) to an axially middle portion of each of the projections 16 from the outer peripheral surface of the skirt wall 6 to cut the skirt wall 6 while retaining at least a part of each of the projections 16. The uncut, retained portion of each of the projections 16 constitutes a so-called bridge portion 18, and the tamper evident bottom portion 12 is connected to the main portion 10 of the skirt wall 6 via the bridge portions 18.

A truncated conical portion 20 gradually increasing in outer diameter in a downward direction is formed near a lower end part of the outer peripheral surface of the main portion 10 of the skirt wall 6. The outer peripheral surface of the tamper evident bottom portion 12 is also in a truncated conical shape gradually increasing in outer diameter in a downward direction. At a site above the truncated conical portion 20, in the outer peripheral surface of the main portion 10, knurls 22 are formed for preventing slippage of fingers applied thereto. An internal thread 24 is formed on the inner surface of the main portion 10 of the skirt wall 6. In the internal thread 24, notches 26 extending in the axial direction are formed with suitable spacing in the circumferential direction. These notches 26 constitute so-called air passages for allowing the passage of air when the mouth-and-neck portion of the container is unsealed.

Engaging means 28 are formed on the inner peripheral surface of the tamper evident bottom portion 12. The engaging means 28 in the illustrated embodiment are composed of an annular protruding piece 30 extending continuously in the circumferential direction. The annular protruding piece 30 protrudes upwardly obliquely in a radially inward direction from its base edge connected to the inner peripheral surface of the tamper evident bottom portion 12. In the annular protruding piece 30, slits 32 extending from the front end of the annular protruding piece 30 as far as a site close to the base edge thereof are formed with spacing in the circumferential direction. If desired, the engaging means can be constituted, instead of the annular protruding piece 30, from a protruding piece, a projection or a protuberance of other suitable shape, such as a flap piece, an arcuate projection, or a ratchet pawl (in the case of a ratchet pawl, engaged means in the mouth-and-neck portion of the container to be described later on is composed of a corresponding ratchet pawl rather than an annular jaw portion).

Figure 2:
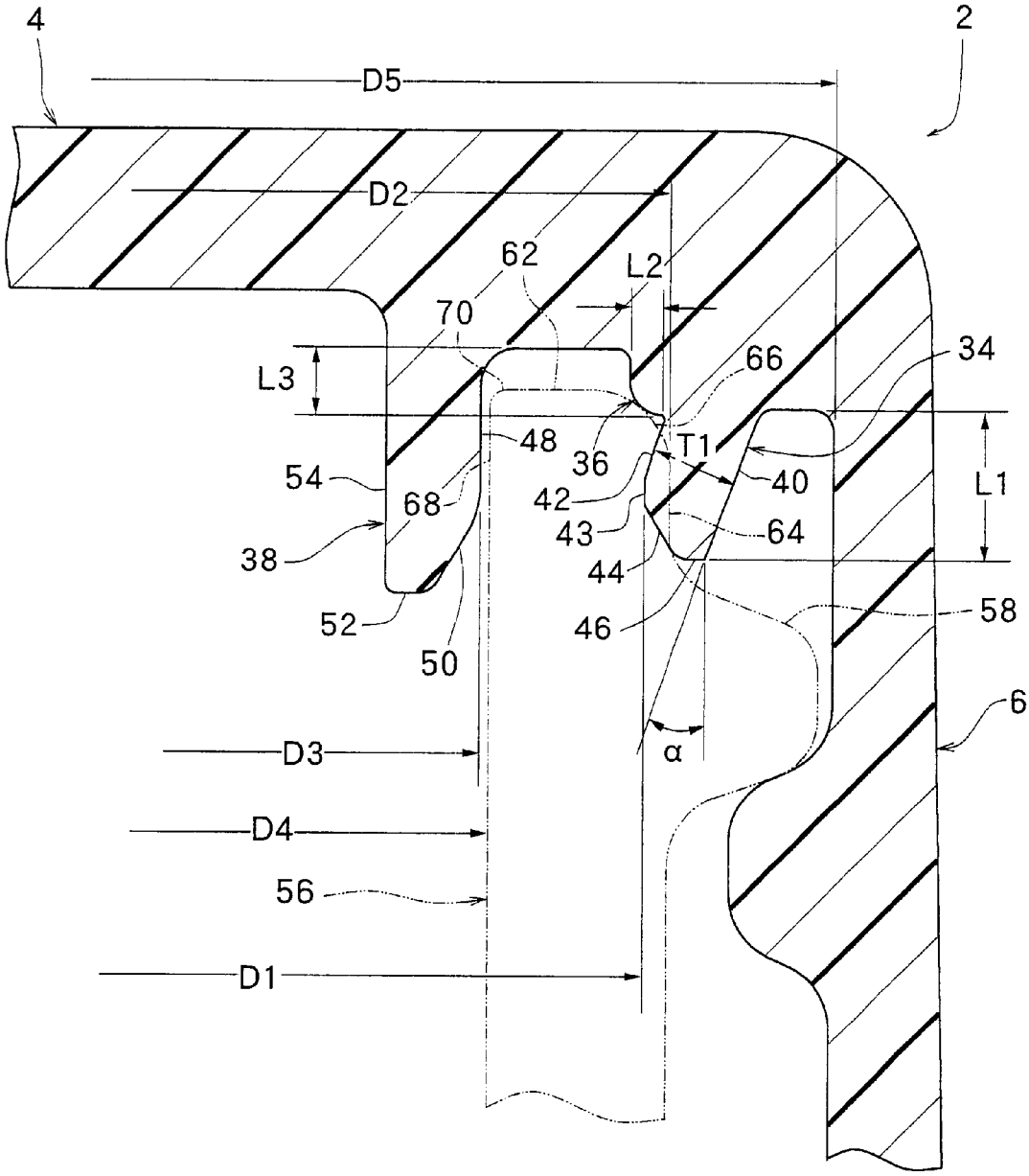
FIG. 2 is an enlarged partial sectional view showing, on an enlarged scale, a part of the container closure of FIG. 1.

Further with reference to FIG. 2 along with FIG. 1, an annular seal piece 34, an annular contact piece 36, and an annular positioning piece 38 are formed in an outer peripheral edge portion of the inner surface of the top panel wall 4. The annular seal piece 34 in the illustrated embodiment extends downwardly obliquely in a radially inward direction from the inner surface of the top panel wall 4. In more detail, the annular seal piece 34 has an outer peripheral surface 40 extending downwardly in a radially inward direction at an inclination angle of $\alpha$ which may be about 20 degrees, an upper inner peripheral surface 42 extending substantially parallel to the outer peripheral surface 40, an intermediate inner peripheral surface 43 continuing from the upper inner peripheral surface 42 and extending substantially vertically downwardly, a lower inner peripheral surface 44 continuing from the intermediate inner peripheral surface 43 and extending downwardly in a radially outward direction, and a front end surface 46 extending nearly horizontally. The annular contact piece 36 is situated immediately inwardly of the annular seal piece 34 when viewed in a radial direction, and is formed from a bulgy portion bulging downwardly in a convex form from the inner surface of the top panel wall 4. The annular positioning piece 38 is located at a required distance from the contact piece 36 in the radially inward direction and extends downward substantially vertically from the inner surface of the top panel wall 4. The annular positioning piece 38 has an upper outer peripheral surface 48 extending substantially vertically, a lower outer peripheral surface 50 extending downwardly obliquely in a radially inward direction, a front end surface 52 extending substantially horizontally, and an inner peripheral surface 54 extending substantially vertically.

In FIG. 2, a part of the mouth-and-neck portion of the container, to which the container closure 2 is applied, is also illustrated by a two-dot chain line. The container, which can be formed from a suitable plastic material such as polyethylene terephthalate or glass, has a mouth-and-neck portion 56 of a nearly cylindrical shape. An external thread 58 and an annular engagement jaw portion 60 (FIG. 3), positioned below the external thread 58, are formed on the outer peripheral surface of the mouth-and-neck portion 56. An upper end part positioned above the external thread 58 is defined by an annular top surface 62 extending substantially horizontally, a cylindrical outer peripheral surface 64 extending substantially vertically, an annular boundary surface 66 extending from the annular top surface 62 to the cylindrical outer peripheral surface 64 substantially arcuately in a sectional view, a cylindrical inner peripheral surface 68 extending substantially vertically, and an annular boundary surface 70 extending arcuately in a sectional view over a slight length between the cylindrical inner peripheral surface 68 and the annular top surface 62.

As will be understood by reference to FIG. 2, the minimum inner diameter D1 of the annular seal piece 34 in the container closure 2 is set to be somewhat smaller than the outer diameter D2 of the upper end part in the mouth-and-neck portion 56 of the container, and preferably D2−D1= about 0.30 to 1.00 mm. If D2–D1 is excessively small, sealing of the mouth-and-neck portion 56 by the annular seal piece 34 tends to be imperfect. If D2–D1 is too large, an operation of mounting the container closure on the mouth-and-neck portion 56 tends to become difficult. The maximum outer diameter D3 of the annular positioning piece 38 is set to be slightly smaller than the inner diameter D4 of the upper end part in the mouth-and-neck portion 56 of the container, and preferably D4–D3=about 0.07 to 0.16 mm. If D4–D3 is too small, positioning the annular positioning piece 38 in the mouth-and-neck portion 56 when mounting the container closure on the mouth-and-neck portion of the container tends to become considerably difficult. If D4–D3 is too large, on the other hand, the action of alignment of the mouth-and-neck portion 56 and the container closure 2 by the annular positioning piece 38 tends to become ineffective.

Figure 3:
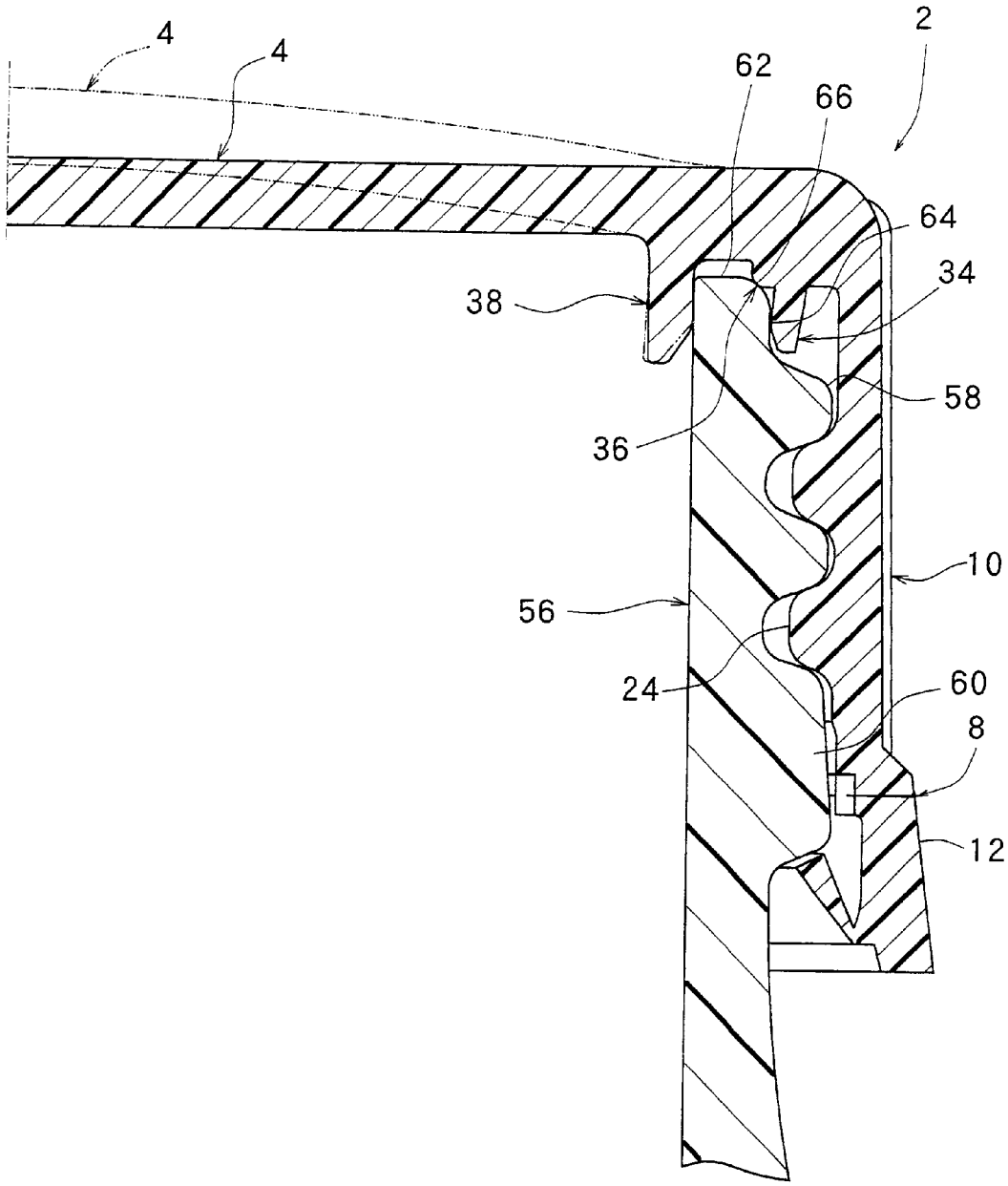
FIG. 3 is a partial sectional view showing the container closure of FIG. 1 mounted on a mouth-and-neck portion of a container.

FIG. 3 shows the container closure 2 mounted, as required, on the mouth-and-neck portion 56 of the container. Further referring to FIG. 3 along with FIGS. 1 and 2, in mounting the container closure 2 on the mouth-and-neck portion 56 of the container to seal the mouth-and-neck portion 56, the container closure 2 is capped over the mouth-and-neck portion 56 and turned in a closing direction, namely, clockwise when viewed from above in FIG. 3 to screw the internal thread 24 of the container closure 2 onto the external thread 58 of the mouth-and-neck portion 56. During this motion, the annular positioning piece 38 of the container closure 2 is lowered along the inner peripheral surface of the mouth-and-neck portion 56. As a result, the container closure 2 is aligned with the mouth-and-neck portion 56. More specifically, the central axis of the container closure 2 is aligned with the central axis of the mouth-and-neck portion 56. When the container closure 2 is turned in the closing direction with a required torque to screw the internal thread 24 onto the external thread 58 until a state as illustrated in FIG. 3, the annular seal piece 34 of the container closure 2 is brought into intimate contact with the outer peripheral surface 64 of the upper end part of the mouth-and-neck portion 56. As a result, the annular seal piece 34 is somewhat deflected radially outwardly to seal the mouth-and-neck portion 56. The annular contact piece 36 of the container closure 2 is in contact with the annular boundary surface 66 of the upper end part of the mouth-and-neck portion 56, and thereby is somewhat compressed. The engaging means 28 formed in the tamper evident bottom portion 12 of the container closure 2 passes over the annular jaw portion 60 of the mouth-and-neck portion 56 while elastically deforming radially outwardly, then elastically returns to its original shape, and is engaged with the lower surface of the annular jaw portion 60.

When the ambient temperature rises to generate a considerably high gas pressure in the container, with the mouth-and-neck portion 56 of the container being sealed with the container closure 2 mounted thereon, the dome phenomenon occurs in the top panel wall 4 of the container closure 2, as indicated by a two-dot chain line in FIG. 3. That is, the top panel wall 4 bulges upward more greatly in its region closer to its center, until being deformed in a domic shape, with the site of the annular contact piece 36 in contact with the annular boundary surface 66 of the upper end part of the mouth-and-neck portion 56 as a fulcrum. However, the annular contact piece 36 is contacted with the annular boundary surface 66, rather than the annular top surface 62, in the upper end part of the mouth-and-neck portion 56, as will be understood from the descriptions of Examples and Comparative Example to be offered hereinbelow. Thus, even when a considerably great stacking load acts on the outer surface of the top panel wall 4 of the container closure 2 in which the dome phenomenon has occurred, sealing of the mouth-and-neck portion 56 is not destroyed, but is maintained.

To unseal the mouth-and-neck portion 56 of the container, the container closure 2 is turned in an opening direction, i.e., counterclockwise when viewed from above in FIG. 3. During this motion, the tamper evident bottom portion 12 is inhibited from ascending, because the engaging means 28 formed on its inner peripheral surface is engaged with the lower surface of the annular jaw portion 60 formed on the outer peripheral surface of the mouth-and-neck portion 56 of the container. On the other hand, the other portions of the container closure 2 are raised in accordance with the turning of the container closure 2, since the engagement between the external thread 58 and the internal thread 24 is released. Thus, considerable stress is caused to the breakable line 8 formed in the skirt wall 6, more specifically to its bridge portions 18, whereby the bridge portions 18 are broken to separate the tamper evident bottom portion 12 from the main portion 10 of the skirt wall 6. Then, the portions of the container closure 2, other than the tamper evident bottom portion 12, are moved freely upwards in accordance with the turning of the container closure 2 and are released from the mouth-and-neck portion 56. When the portions of the container closure 2, other than the tamper evident bottom portion 12, are moved upward over a required distance, the contact piece 36 is separated from the annular boundary surface 66 of the upper end part of the mouth-and-neck portion 56, and the annular seal portion 34 is also separated from the outer peripheral surface 64 of the upper end part of the mouth-and-neck portion 56, whereby sealing of the mouth-and-neck portion 56 is eliminated.

In the illustrated embodiment, in opening the mouth-and-neck portion 56 of the container, all the bridge portions 18 in the breakable line 8 formed in the skirt wall 6 of the container closure 2 are broken, so that the tamper evident bottom portion 12 is completely separated from the main portion 10 of the skirt wall 6. Thus, the tamper evident bottom portion 12 is not released from the mouth-and-neck portion 56, but is left on the mouth-and-neck portion 56. If desired, at least one of the bridge portions 18 in the breakable line 8 may be formed as a strong bridge portion which is not broken, but retained. Moreover, a breakable line (not shown) extending in the axial direction may be formed in the tamper evident bottom portion 12. According to these features, in unsealing the mouth-and-neck portion 56, the axially extending breakable line is broken, whereby the tamper evident bottom portion 12 is developed from an endless annular form into a band form with ends. Such tamper evident bottom portion 12 can be released from the mouth-and-neck portion 56 while keeping connected to the main portion 10 of the skirt wall 6 via the strong bridge portion that is not broken, but retained.

Figure 4:
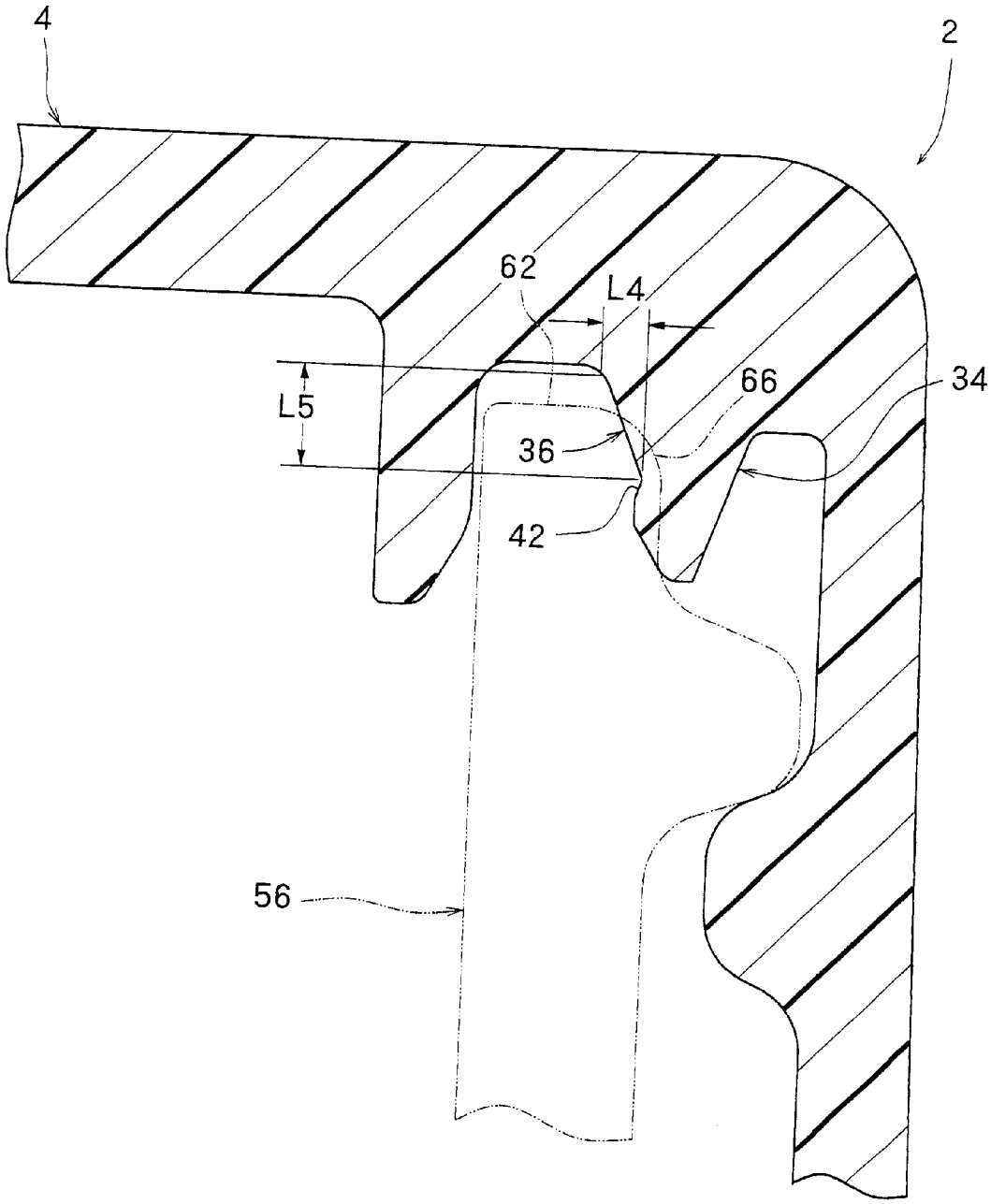
FIG. 4 is a partially enlarged sectional view showing, on an enlarged scale, a part of another preferred embodiment of a container closure constituted in accordance with the present invention.

FIG. 4 shows another embodiment of the container closure constituted in accordance with the present invention. In the embodiment illustrated in FIG. 4, the surface of the annular contact piece 36 is composed of an inclined surface extending upwardly obliquely in a radially inward direction from the base portion of the annular seal piece 34, more specifically, the upper end of the upper inner peripheral surface 42 of the annular seal piece 34. The radially outward edge of the annular contact piece 36 in the embodiment illustrated in FIG. 4 is positioned slightly lower than the radially outward edge of the annular contact piece 36 in the embodiment illustrated in FIGS. 1 to 3. Thus, the axial length of the upper inner peripheral surface of the annular seal piece 34 in the embodiment illustrated in FIG. 4 is slightly smaller than the axial length of the upper inner peripheral surface 42 of the annular seal piece 34 illustrated in FIGS. 1 to 3. The annular contact piece 36 in the embodiment illustrated in FIG. 4 is somewhat compressed upon contact with the annular boundary surface 66 of the upper end part of the mouth-and-neck portion 56 of the container, as is the annular contact piece 36 in the container closure 2 in the embodiment shown in FIGS. 1 to 3. The other features of the embodiment shown in FIG. 4 are substantially the same as in the embodiment illustrated in FIGS. 1 to 3.

Figure 5:
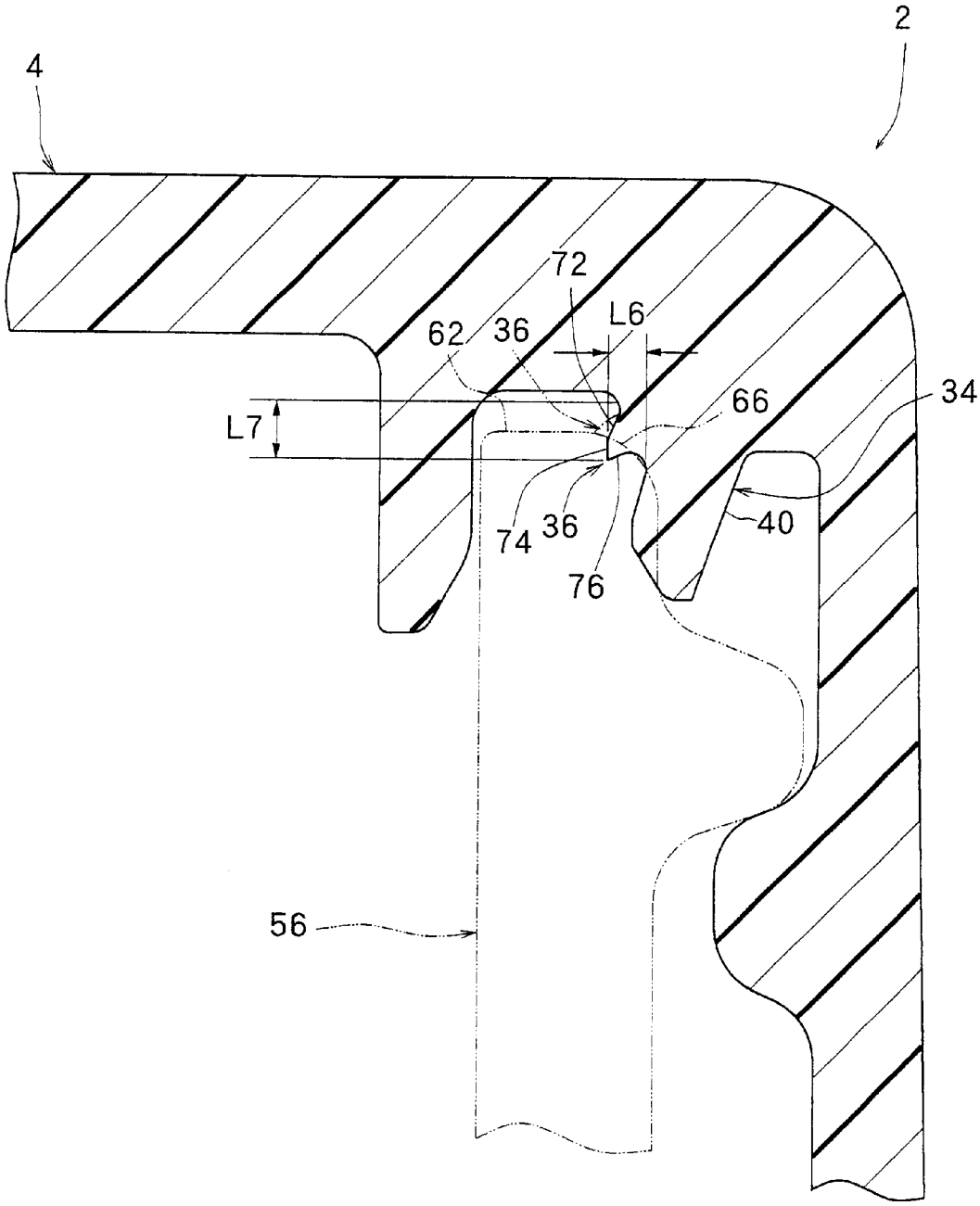
FIG. 5 is a partially enlarged sectional view showing, on an enlarged scale, a part of still another preferred embodiment of a container closure constituted in accordance with the present invention.

FIG. 5 shows still another embodiment of the container closure constituted in accordance with the present invention. In the embodiment illustrated in FIG. 5, the annular contact piece 36 is composed of a projecting piece projecting downwardly or radially inwardly from an outer peripheral edge portion of the inner surface of the top panel wall 4. The annular contact piece 36 has an upper inner peripheral surface 72 extending nearly parallel to the outer peripheral surface 40 of the annular seal piece 34, a lower inner peripheral surface 74 extending substantially vertically, and a lower surface 76 extending downwardly obliquely in a radially inward direction at a slight inclination angle, which may be about 10 degrees, relative to the horizontal. Such annular contact piece 36 is deflected upward upon contact with the annular boundary surface 66 of the upper end part of the mouth-and-neck portion 56, as shown by two-dot chain lines in FIG. 5. The other features in the embodiment illustrated in FIG. 5 are substantially the same as in the embodiment shown in FIGS. 1 to 3.

As will be understood from the descriptions of the Examples and Comparative Example to be offered later on, in the embodiment shown in FIG. 5 as well as in the embodiment shown in FIG. 4, the annular contact piece 36 is contacted with the annular boundary surface 66, rather than the annular top surface 62, in the upper end part of the mouth-and-neck portion 56. Thus, even when a considerably great stacking load acts on the outer surface of the top panel wall 4 of the container closure 2 in which the dome phenomenon has occurred, sealing of the mouth-and-neck portion 56 is not destroyed, but maintained.

Figure 6:
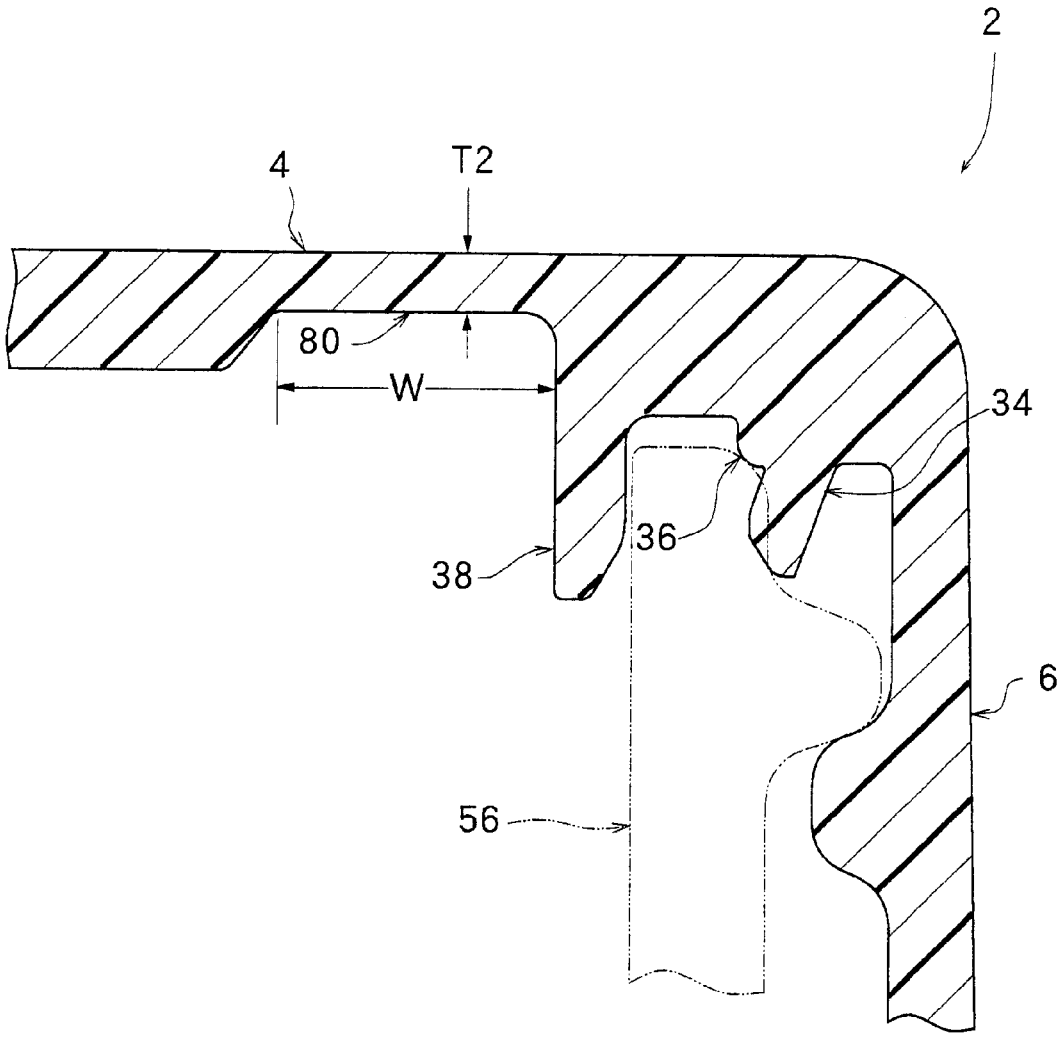
FIG. 6 is a partial sectional view showing, on an enlarged scale, a part of a further preferred embodiment of a container closure constituted in accordance with the present invention.
Figure 7:
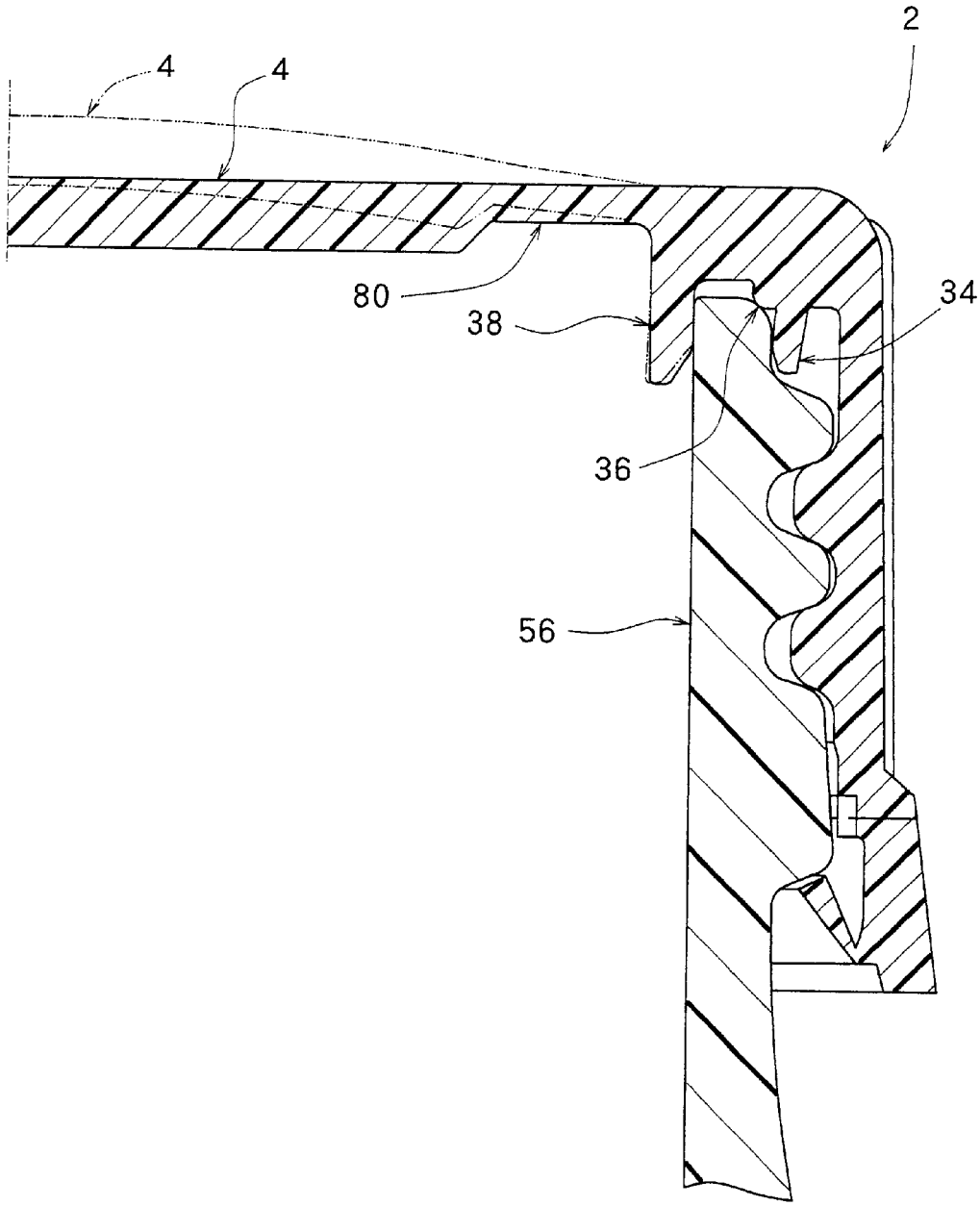
FIG. 7 is a partial sectional view showing the container closure of FIG. 6 mounted on the mouth-and-neck portion of a container.

FIGS. 6 and 7 illustrate the container closure 2 provided with the improvement according to the first aspect of the present invention, and the improvement according to the second aspect of the present invention. In the container closure 2 shown in FIGS. 6 and 7, an annular thin-walled region 80 is formed in the outer peripheral edge portion of the top panel wall 4. It is important that the annular thin-walled region 80 be positioned inwardly of the annular seal piece 34. In the illustrated embodiment, the annular thin-walled region 80 is located adjacent to and radially inwardly of the annular positioning piece 38. The width W of the annular thin-walled region 80 is preferably 0.5 to 5.0 mm, especially 1.5 to 3.0 mm. The thickness T2 of the annular thin-walled region 80 may be about 0.5 to 1.1 mm. If the width W of the annular thin-walled region 80 is too small, or the thickness T2 of the annular thin-walled region 80 is too large, deformation or movement of the annular seal piece 34 cannot be fully suppressed, when the top panel wall 4 is deformed, as will be stated later on. If the width W of the annular thin-walled region 80 is too large, or the thickness T2 of the annular thin-walled region 80 is too small, the strength of the top panel wall 4 becomes excessively low. The container closure 2 shown in FIGS. 6 and 7 is substantially the same as the container closure 2 shown in FIGS. 1 to 3, except that the annular thin-walled region 80 is formed.

When the ambient temperature rises to generate a considerably high gas pressure in the container, with the mouth-and-neck portion 56 of the container being sealed with the container closure 2 of FIGS. 6 and 7 mounted thereon, the dome phenomenon occurs in the top panel wall 4 of the container closure 2, as indicated by two-dot chain lines in FIG. 7. That is, the top panel wall 4 bulges upward more greatly in its region closer to its center, until being deformed in a domic shape. However, in the container closure 2 shown in FIGS. 6 and 7, the annular thin-walled region 80 is formed in the outer peripheral edge portion of the top panel wall 4. Thus, deformation of the top panel wall 4 is restricted mainly to the region radially inward of the annular thin-walled region 80, and deformation of the top panel wall 4 in the area radially outward of the annular thin-walled region 80 is fully suppressed. Hence, even when a considerably great stacking load acts on the outer surface of the top panel wall 4 of the container closure 2 in which the dome phenomenon has occurred, sealing of the mouth-and-neck portion 56 is not destroyed, but is reliably maintained.

Figure 8:
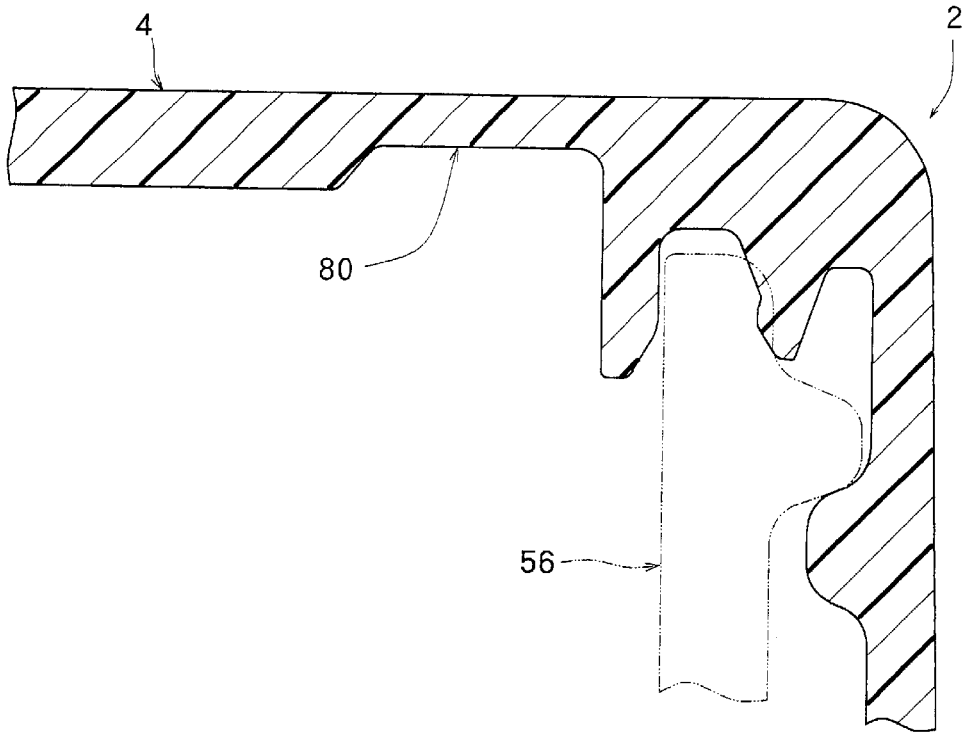
FIG. 8 is a partially enlarged sectional view showing, on an enlarged scale, a part of a still further preferred embodiment of a container closure constituted in accordance with the present invention.
Figure 9:
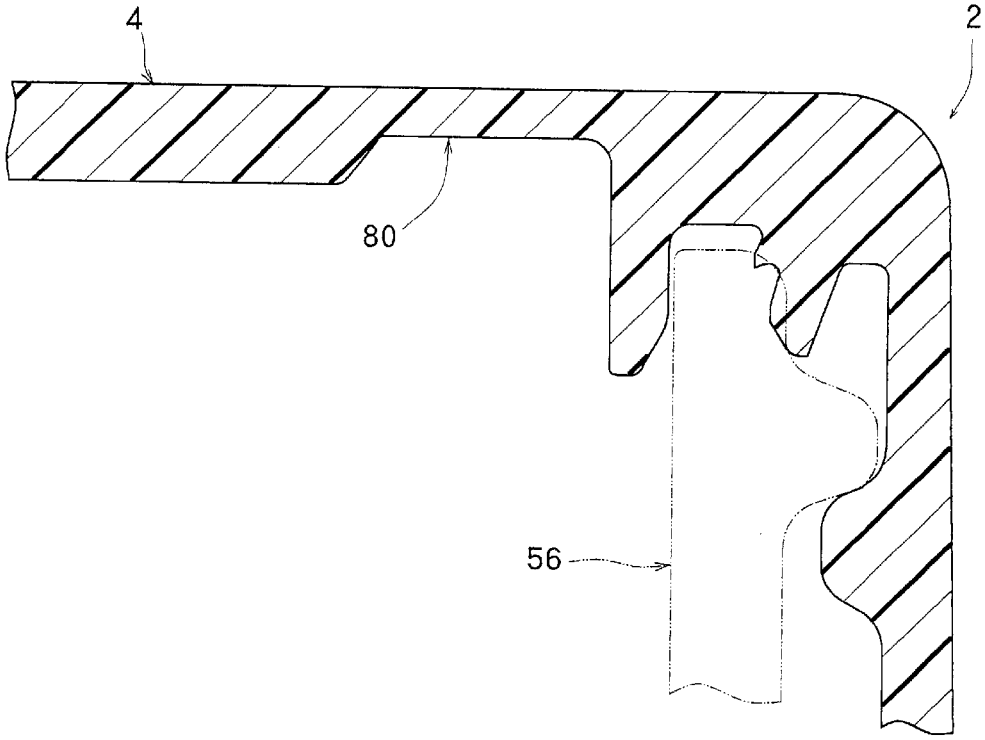
FIG. 9 is a partially enlarged sectional view showing, on an enlarged scale, a part of an additional preferred embodiment of a container closure constituted in accordance with the present invention.

FIGS. 8 and 9 show further embodiments of the container closure constituted in accordance with the present invention. The container closure 2 shown in FIG. 8 is substantially the same as the container closure 2 shown in FIG. 4, except that the annular thin-walled region 80 is formed in the outer peripheral edge portion of the top panel wall 4. The container closure 2 shown in FIG. 9 is substantially the same as the container closure 2 shown in FIG. 5, except that the annular thin-walled region 80 is formed in the outer peripheral edge portion of the top panel wall 4.

Next, Examples of the container closure of the present invention will be described together with a Comparative Example.

EXAMPLE 1

Polypropylene was compression molded to produce 30 container closures of a shape as shown in FIGS. 1 to 3. The dimensions of an essential portion of each of the container closures were as follows (see FIGS. 1 and 2):

| | |
|---|---|
| Overall height H of container closure | 20.16 mm |
| Inner diameter D5 of upper end portion of skirt wall | 27.80 mm |
| Axial length L1 of annular seal piece | 1.20 mm |
| Thickness T1 of base portion of annular seal piece | 0.80 mm |
| Amount L2 of horizontal bulge of annular contact piece | 0.40 mm |
| Amount L3 of axial bulge of annular contact piece | 0.40 mm |
| Minimum inner diameter D1 of annular seal piece | 24.30 mm |
| Outer diameter D2 of outer peripheral surface of mouth-and-neck portion of container | 24.94 mm |
| Maximum outer diameter D3 of annular positioning piece | 21.70 mm |
| Inner diameter D4 of inner peripheral surface of mouth-and-neck portion of container | 21.74 mm |

The above container closure was subjected to the following stacking load resistance test: A polyethylene terephthalate container having a mouth-and-neck portion as shown in FIGS. 2 and 3 was filled with carbonated water. Then, the container closure was mounted on the mouth-and-neck portion to seal the mouth-and-neck portion. Then, the container was preheated at 40° C. for 48 hours. At this time, the top panel wall of the container closure was observed to find that a dome phenomenon as indicated by the two-dot chain lines in FIG. 3 occurred. Then, the container was immersed in a water bath of 40° C., and a stacking load of up to 45.5 kg was imposed on the entire upper surface of the top panel wall of the container closure at a rate of 2.3 kg/second. During this process, it was examined whether or not carbon dioxide gas leaked from inside the container, namely, whether the sealing was destroyed or not. The results are shown in Table 1.

EXAMPLE 2

There were produced 30 of the same container closures as in Example 1, except that the shape of the container closure was as shown in FIG. 4, and

| | |
|---|---|
| Horizontal length L4 of inclined surface of annular contact piece | 0.15 mm |
| Axial length L5 of inclined surface of annular contact piece | 0.80 mm |

The above container closure was subjected to the same stacking load resistance test as in Example 1. The results are shown in Table 1.

EXAMPLE 3

There were produced 30 of the same container closures as in Example 1, except that the shape of the container closure was as shown in FIG. 5, and

| | |
|---|---|
| Amount L6 of horizontal protrusion of annular contact piece | 0.30 mm |
| Amount L7 of axial protrusion of annular contact piece | 0.50 mm |

The above container closure was subjected to the same stacking load resistance test as in Example 1. The results are shown in Table 1.

EXAMPLE 4

There were produced 30 of the same container closures as in Example 1, except that the shape of the container closure was as shown in FIGS. 6 and 7, and

| | |
|---|---|
| Width W of annular thin-walled region | 3.00 mm |
| Thickness T of annular thin-walled region | 0.80 mm |

The above container closure was subjected to the same stacking load resistance test as in Example 1. The results are shown in Table 1.

EXAMPLE 5

There were produced 30 of the same container closures as in Example 2, except that the shape of the container closure was as shown in FIG. 8, and

| | |
|---|---|
| Width W of annular thin-walled region | 3.00 mm |
| Thickness T of annular thin-walled region | 0.80 mm |

The above container closure was subjected to the same stacking load resistance test as in Example 1. The results are shown in Table 1.

EXAMPLE 6

There were produced 30 of the same container closures as in Example 2, except that the shape of the container closure was as shown in FIG. 9, and

| | |
|---|---|
| Width W of annular thin-walled region | 3.00 mm |
| Thickness T of annular thin-walled region | 0.80 mm |

The above container closure was subjected to the same stacking load resistance test as in Example 1. The results are shown in Table 1.

Comparative Example

Figure 10:
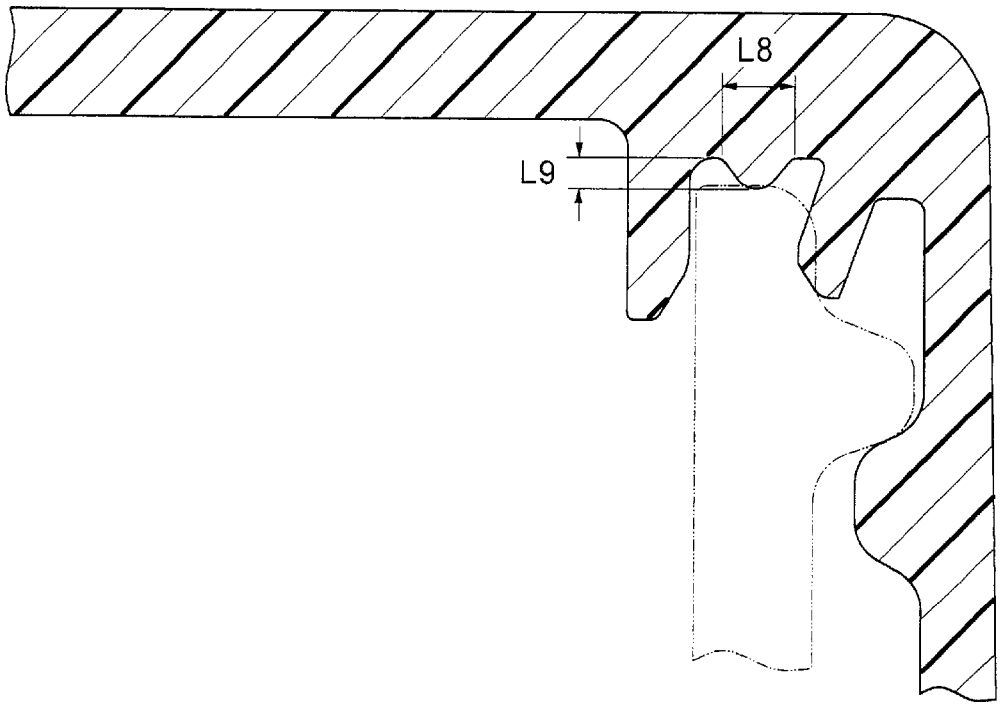
FIG. 10 is a partially enlarged sectional view showing, on an enlarged scale, a part of a container closure produced in a comparative example.

There were produced 30 of the same container closures as in Example 1, except that the shape of the container closure was as shown in FIG. 10. No annular thin-walled region was formed. The annular contact piece was in contact with the horizontally extending annular top surface of the container, rather than the annular boundary surface of the upper end part of the mouth-and-neck portion, and had the following dimensions:

| | |
|---|---|
| Width L8 of annular contact piece | 0.70 mm |
| Amount L9 of projection of annular contact piece | 0.20 mm |

The above container closure was subjected to the same stacking load resistance test as in Example 1. The results are shown in Table 1.

TABLE 1

| | Ex. 1 | Ex. 2 | Ex. 3 | Ex. 4 | Ex. 5 | Ex. 6 | Comp. Ex. |
|---|---|---|---|---|---|---|---|
| Number of container closures causing much leakage | 0 | 0 | 0 | 0 | 0 | 0 | 30 |
| Number of container closures causing minimum leakage | 5 | 7 | 6 | 0 | 0 | 0 | 0 |

What we claim is:

1. A plastic container closure for a container having an annular top surface extending substantially horizontally, a cylindrical outer peripheral surface extending substantially vertically, and an annular boundary surface extending from the top surface to the outer peripheral surface substantially arcuately in a sectional view, the top surface, the outer peripheral surface, and the boundary surface being formed in an upper end part of a mouth-and-neck portion of the container, said container closure comprising:

a circular top panel wall; and a cylindrical skirt wall extending downwardly from a peripheral edge of said top panel wall, wherein:

said circular top panel wall includes an annular seal piece and an annular contact piece said annular seal piece being integrally formed at an outer peripheral edge portion of an inner surface of said top panel wall, extending downwardly obliquely in a radially inward direction from said outer peripheral edge portion, and being adapted to be brought into intimate contact with the outer peripheral surface of the mouth-and-neck portion of the container to deflect the annular seal piece radially outwardly, said annular contact piece being integrally formed at said outer peripheral edge portion of said inner surface of said top panel wall, radially inwardly of said annular seal piece and being adapted to be brought into contact with the boundary surface of the mouth-and-neck portion of the container so as to prevent the annular top surface of the container from contacting said container closure.

2. The plastic container closure of claim 1, wherein said annular contact piece comprises a bulgy portion which bulges downwardly and is adapted to be compressed upon contact with the boundary surface of the mouth-and-neck portion of the container.

3. The plastic container closure of claim 1, wherein said annular contact piece has an inclined surface extending obliquely upwardly from a base portion of said annular seal piece in a radially inward direction, and is adapted to be compressed upon contact with the boundary surface of the mouth-and-neck portion of the container.

4. The plastic container closure of claim 1, wherein said annular contact piece comprises a protrusive portion which protrudes downward or radially inwardly from said outer peripheral edge portion of said inner surface of said top panel wall, and is adapted to be deflected upward upon contact with the boundary surface of the mouth-and-neck portion of the container.

5. The plastic container closure of claim 1, wherein when a minimum inner diameter of said annular seal piece is designated as D1, and an outer diameter of the outer peripheral surface of the mouth-and-neck portion of the container is designated as D2, D2−D1=0.30 to 1.00 mm.

6. The plastic container closure of claim 1, further comprising:

an annular positioning piece located radially inwardly of said annular contact piece and extending downward from said outer peripheral edge portion of said inner surface of the top panel wall, radially inwardly of said annular contact piece; and wherein:

when a maximum outer diameter of said annular positioning piece is designated as D3, and the mouth-and-neck portion of the container includes a cylindrical inner peripheral surface extending substantially vertically and having an inner diameter designated as D4, D4−D3=0.07 to 0.16 mm.

7. The plastic container closure of claim 1, wherein said outer peripheral edge portion of said inner surface of said top panel wall includes an annular thin-walled region formed radially inwardly of said annular contact piece.

8. The plastic container closure of claim 7, wherein said annular thin-walled region has a width of 0.5 to 5.0 mm.

9. The plastic container closure of claim 7, wherein said annular thin-walled region has a thickness of 0.5 to 1.1 mm.

10. The plastic container closure of claim 7, further comprising:

an annular positioning piece located radially inwardly of said annular contact piece and extending downward from said outer peripheral edge portion of said inner surface of said top panel wall, radially inwardly of side annular contact piece; and said annular thin-walled region is positioned adjacent to and radially inwardly of said annular positioning piece.

* * * * *